US011234502B2

(12) United States Patent
Van Geer

(10) Patent No.: US 11,234,502 B2
(45) Date of Patent: Feb. 1, 2022

(54) CREDIT CARD EJECTOR HAVING BREAK COUPLING

(71) Applicant: René Johan Van Geer, Rijswijk (NL)

(72) Inventor: René Johan Van Geer, Rijswijk (NL)

(73) Assignee: R.J. VAN GEER BEHEER B.V., Rijswijk (NL)

( * ) Notice: Subject to any disclaimer, the term of this patent is extended or adjusted under 35 U.S.C. 154(b) by 462 days.

(21) Appl. No.: 16/303,542

(22) PCT Filed: May 26, 2017

(86) PCT No.: PCT/NL2017/050341
§ 371 (c)(1),
(2) Date: Nov. 20, 2018

(87) PCT Pub. No.: WO2017/204644
PCT Pub. Date: Nov. 30, 2017

(65) Prior Publication Data

US 2020/0315308 A1 Oct. 8, 2020

(30) Foreign Application Priority Data

May 26, 2016 (NL) ..... 2016844
May 25, 2017 (NL) ..... 2018978

(51) Int. Cl.
*A45C 11/18* (2006.01)

(52) U.S. Cl.
CPC ..... *A45C 11/182* (2013.01)

(58) Field of Classification Search
CPC ..... A45C 11/182; A45C 11/18; B65D 83/08
USPC ..... 150/147
See application file for complete search history.

(56) References Cited

U.S. PATENT DOCUMENTS

| | | | | |
|---|---|---|---|---|
| 4,887,739 | A | 12/1989 | Parker | |
| 5,718,329 | A | 2/1998 | Ippolito et al. | |
| 8,899,411 | B2 | 12/2014 | Van Geer | |
| 9,980,546 | B2 * | 5/2018 | Van Der Laan | B33Y 50/02 |
| 2002/0074246 | A1 | 6/2002 | Tiscione et al. | |
| 2008/0190784 | A1 | 8/2008 | Phillips | |
| 2014/0014676 | A1 | 1/2014 | Minson et al. | |

(Continued)

FOREIGN PATENT DOCUMENTS

| | | | |
|---|---|---|---|
| CH | 702919 | B1 | 10/2011 |
| CN | 204169237 | U | 2/2015 |
| EP | 0 287 532 | A2 | 10/1988 |

(Continued)

OTHER PUBLICATIONS

International Search Report and Written Opinion, dated Sep. 6, 2017, from corresponding PCT application No. PCT/NL2017/050341.

*Primary Examiner* — Sue A Weaver
(74) *Attorney, Agent, or Firm* — Nixon & Vanderhye

(57) ABSTRACT

Disclosed is a holder for cards, including a housing which tightly fits around a stack of cards and has a card opening for locating and removing cards. Within the housing a card eject feature is provided such that the cards through the card opening can be partly slid from the housing. The card eject feature has an ejector arm which is moved by operating a finger button and forces the cards simultaneously to partly exit the housing. The card eject feature includes a barrel for normal duty operation and a trigger for heavy duty operation to engage and force cards to partly exit the housing.

17 Claims, 10 Drawing Sheets

(56) References Cited

U.S. PATENT DOCUMENTS

2015/0335118 A1 11/2015 Van Geer

FOREIGN PATENT DOCUMENTS

Figure 1:
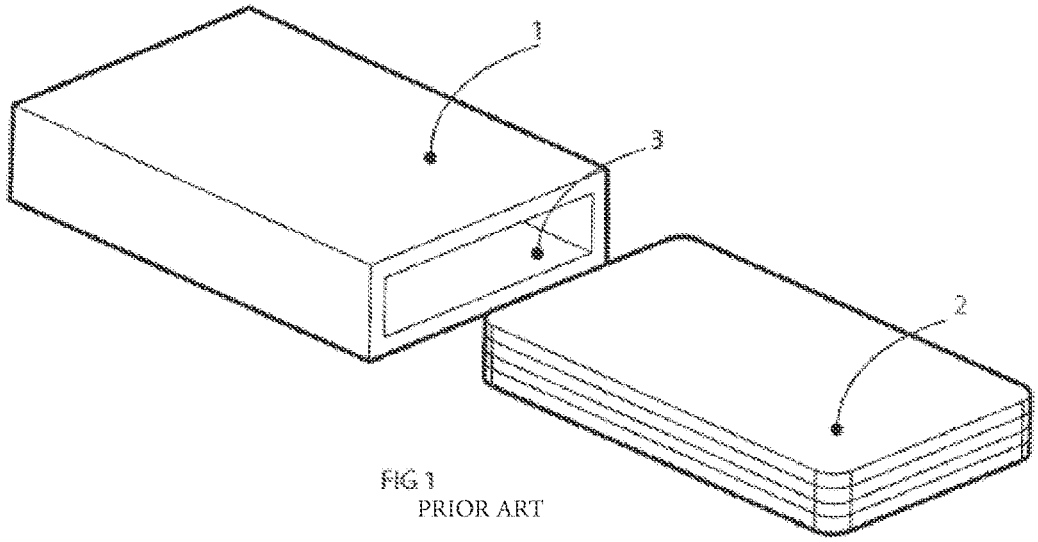
FIG 1 PRIOR ART

| | | | |
|---|---|---|---|
| JP | S60-179484 | U | 11/1985 |
| WO | 2010/0137975 | A2 | 12/2010 |
| WO | 2014/098580 | A1 | 6/2014 |

* cited by examiner

CREDIT CARD EJECTOR HAVING BREAK COUPLING

CROSS-REFERENCE TO RELATED APPLICATIONS

This application claims the benefit of PCT/NL2017/050341 filed May 26, 2017, which claims the benefit of NL application No. 2016844 filed May 26, 2016 and NL application No. 2018978 filed May 25, 2017

BACKGROUND OF THE INVENTION

Field of the Invention

The invention relates to a card holder provided with a device (further also called "ejector") to eject or dispense the cards, e.g. credit cards or bank cards, or different flat or plate like objects, from the holder and wherein the card or cards tightly fit within the holder, for which the holder has a cavity similar to the shape and slightly bigger than the card or cards stack. The ejected cards are preferably presented as a staggered stack.

For the so called credit card format the main dimensions suffice ISO 7810 and the thickness and roundings suffice ISO 7813. This format is applied for many cards with a diversity of applications: bank cards, driving licenses, membership cards, entry tickets, reduction cards, savings cards, ID-cards, etc.

The cards preferably have a solid, not foldable shape and a smooth, slippery, low friction surface. The holder preferably has a rigid flat box or sleeve shape.

Description of Related Art

The prior art discloses in EP-A 0 287 532, CH702919 B1, WO2010137975 and WO2014098580 a pivoting ejector arm provided with a stepped profile along its length such that each card engages with a different edge at the ejector arm, the cards are simultaneously dispensed to present a staggered stack of cards, partly projecting out the card holder. Different card holders are disclosed in US2002/074246, U.S. Pat. Nos. 4,887,739, 5,718,329 and JP S60-179484 U.

Above cited WO2014098580 addresses the problem of jamming of the ejector arm at the time of ejecting the stack of cards.

The above cited prior art provides background knowledge for the present invention. The disclosure of this prior art is enclosed herein by reference.

BRIEF SUMMARY OF THE INVENTION

The object of the invention is versatile. In one aspect the object is a further improvement of the prior art in avoiding or solving jamming of the card eject feature, or part of it, e.g. the ejector arm, or jamming of the cards at the time of ejecting the stack of cards.

Additional possible aspects are a comfortable, simple and accurate operation of the holder with long life. In yet another aspect the object is error free handling, low production costs, attractive appearance. Thus the invention is directed to a card holder according to the claims. Other aspects can be learned from the specification, drawings or claims. Two or more aspects can be combined.

Preferably one or more of the following applies to the device: a rectangular shape, preferably elongated; fixed shape, robust, of light weight material, e.g. metal or polymer material, polyester, PP; box or sleeve shaped; the card storage space receives a cards stack with tight fit; fixed length, width and depth; an ejector mechanism of the cards, preferably at the longitudinal end of the card holder opposite the card access opening to the housing space in which the cards are stored.

Preferably the invention is directed to a card holder provided with an ejector mechanism dispensing the complete stack of cards, thus all cards of the stack are dispensed simultaneously, e.g. since the ejector mechanism simultaneously engages the complete cards stack at the time of ejecting the cards. Preferably the cards are urged from the housing in such a manner that a staggered stack of cards, partly projecting out the card holder, is presented. This is preferably provided by the design of the ejector device.

More preferably the design of the card holder or the ejector device is such that when the cards stack is completely contained within the card holder, the cards are mutually in register (in other words the cards are not staggered), and preferably is partly projected from the card holder, wherein the cards are presented in a staggered fashion. By presenting the cards in staggered fashion, they can be easily individually identified and individually taken from the stack by two fingers of the hand of the user. The card holder is preferably rigid in relation to the typical loads to which the card holder is exposed during normal daily use.

In particular the holder is designed to receive and dispense credit cards (and different items with dimensions comparable to credit cards, further mentioned as "cards"), preferably wherein a stack of, e.g. at least three, four or five, cards can be housed in the holder, more preferably wherein the cards in the stack are immediately mutually superposed or adjacent, in other words no further object, e.g. spacer, is or needs be present between adjacent cards.

The holder preferably has two pairs of substantially or completely closed and fixed opposite sides, one pair with length and width almost equal to the same card dimensions (also called the "main sides") and this pair spaced by the other (also called the "minor sides") pair (delimiting the stack thickness) such that the card stack tightly fits between these four sides. Preferably these sides are thin walled and/or provide a rigid, sleeve like casing. Of the remaining pair of two opposite sides (typically located at the longitudinal ends of the sleeve) preferably one (also called the "bottom") is permanently substantially or completely closed and the other (also called the "top") is open but could be temporary closed, e.g. by a lid, such that the holder preferably has merely a single open side through which the cards can enter and exit the holder. Thus the holder provides a rigid sleeve with closed bottom. Typically the cards enter and exit the holder by moving parallel to their main sides.

To avoid that the cards can spontaneously leave the card holder, the device is preferably provided with card retaining means, e.g. a (preferably pivoting) removable lid associated with the access opening to open and close it, or clamping or friction means designed to engage e.g. a main side (a side defining a card face) or a minor side (a side defining the card thickness, i.e. the thin side) of the card. E.g. WO2010137975 (above cited) addresses releasably retaining the cards within the housing by friction means and the relevant disclosures are incorporated in here by reference. Retaining means to keep the cards within the holder without closing the top side with a lid, are preferred.

The ejector comprises an ejector element (further also called "arm") moving between a first and second (preferably a retracted and an extended, respectively) position inside the holder and engaging the cards stack, preferably engaging an edge of the cards, to push the cards stack out of the holder while the cards move in a plane parallel to their main faces, preferably such that the cards (with the ejector element in its extended position) partly project from the holder in a stepped or staggered manner. For the purpose of presenting or dispensing the cards in a stepped manner, the ejector arm is preferably provided with a relief profile, preferably having some relation with the thickness of the cards, such that the element has a plurality of spaced features, preferably located along a straight line, e.g. lengthwise of the arm, a such feature designed to engage a single card from the stack, preferably such that by movement of the element within the holder, the one card is moving with the element for a further distance outward compared to another card from the same stack within the holder. In an embodiment such features are projections at the arm each providing an engagement edge (also called "face" or "contact face"), wherein preferably the projections project a different distance from the element such that each engagement face is present at a different level. Preferably the arm is designed such that, in its retracted position, the cards fit within the holder such that the cards are mutually in register, in other words, present a neat stack.

Preferably the height (meaning the dimension normal to the housing main sides and parallel to the thickness direction of the cards or cards stack loaded into the housing) of the ejector arm stepwise increases longitudinally from the free end (in other words the distal end or the end remote from the pivot point or the end opposite the end to which the drive means engage or are mounted). This stepwise increase of height (also named: thickness) provides step shaped features or contact faces for ejecting the cards stack in a staggered fashion.

The number of steps preferably at least equals the number of cards within the stack and/or is at least 4 or 5 or 6 or 7. The steps preferably have approximately equal longitudinal spacing and/or height.

In its extended position, the ejector arm preferably extends diagonally within the holder or makes an angle between 20 and 90 degrees (90 degrees equals a right angle), preferably at least 45 or 55 or 60 degrees and/or less than 85 degrees, compared to its retracted position. In its retracted position, the ejector arm preferably extends parallel to an external side (also called "bottom") or edge of the holder, preferably opposite the side from which the cards are dispensed from within the holder. Preferably the ejector arm rotates or swivels or turns or hinges or pivots between its first and second position, for which it is preferably provided with a hinge or pivot feature, such as a pin or hole, with which it is mounted to the holder. In the alternative a translating movement is feasible.

To provide the movement of the ejector arm, the ejector comprises a drive means associated with the ejector arm. This could be a motoric means however a manually operated drive means, e.g. a finger operated button, is preferred, preferably projecting or located outside the housing. Preferably the ejector arm and the drive means are connected in a rigid manner such that the movement of the drive means is directly transferred to the ejector arm and both these members move as one, e.g. since both these members are integrated in a single, preferably rigid piece. The ejector arm and/or drive means could be injection moulded parts, e.g. of polymeric or plastic or equivalent material.

Preferably the ejector arm provides or is part of, a base or bottom of the holder, or part of it, preventing exit of the cards from the associated side of the holder.

The card ejector feature gives the user the opportunity to partly slide the card stack from the housing. This is a preferred operation before the user can select a card and remove it from the housing.

By the time the eject arm is in its extended position, the cards are partly slid from the housing as a staggered or stepped stack such that each card presents an outside the housing projecting, exposed narrow strip of its upper main side and by viewing these strips the user can see at a blink which cards are present in the holder. Also the user can easy and quick select within the cards stack the desired card and remove it by manually sliding the cards mutually in a direction equal to or opposite the direction in which the cards are slid from the housing from their stored position An embodiment of the card ejector feature of the invention comprises, among others, a step like element, which by the user relative to the housing, e.g. by means of rotation or translation, can be moved against the cards stack, wherein the individual steps of the step like element exert at the individual cards in the stack in the direction of the card opening a force, resulting that the card stack slides outward in stepped shape. The steps have a thickness which is measured parallel to the card thickness and a spacing which is measured perpendicular to the thickness and which determines the degree wherein the cards slide mutually if they slide in stepped shape from the housing. Above cited WO2010137975 and WO2014098580, the contents of which is inserted in here by reference, provide further preferred details of the step like element.

An embodiment of the ejector, or part of it, e.g. the arm, as card remove feature of the card holder of the invention, is provided with or associated, e.g. coupled, with a reset means, e.g. a spring, with the effect that the ejector or the relevant part after operation will always immediately and automatically return to the initial position, e.g. move from the extended to the retracted position. Such by the reset means provided return offers the advantage such that without obstruction the user can slide cards back into the housing during making a selection from the partly exposed cards.

An embodiment of the card holder of the invention has a housing made of a galvanic material. The geometry of the housing of this invention lends itself for fabrication by means of metal extrusion, with which a proper Faraday cage is made.

Preferably the holder is provided with a card ejector means for normal duty use and a card ejector means for heavy duty or emergency use, which two card ejector means could be mutually separate mechanisms or integrated in a single mechanism. E.g. each card ejector means could be provided with its own dedicated driving or operating means, e.g. an operating button or key. A shared, single operating button is preferred, e.g. if both ejector means are integrated in a single mechanism. One or both ejector means can be of pivoting or turning or swiveling type.

Preferably the normal duty ejector is designed to eject the complete cards stack in staggered manner, and the heavy duty neatly and/or only part of the stack. Preferably the heavy duty ejector provides a short lever arm engaging the cards and the normal duty ejector provides a long lever arm engaging the cards, preferably at least 10% or 20% or 50% longer compared to the heavy duty ejector. Preferably the distal end or end region of a lever arm engages the cards.

The ejector mechanism is preferably designed, e.g. comprises means, to switch between engagement of the normal and heavy duty ejector with the cards, preferably reversibly, e.g. by application of a friction or snap coupling which e.g. uncouples above an eject load threshold.

In an embodiment, during operation of the holder to eject the cards, the heavy duty ejector is always operative while the normal duty ejector is selectively operative or inoperative (e.g. if the eject load is below or above, respectively, a load threshold), e.g. in case both ejectors share the same actuator, e.g. operating button. Typically, in such case the heavy duty ejector is merely engaged with the cards if the normal duty ejector is inoperative.

If integrated the heavy duty part could be a projection at the normal duty part, preferably remote from the length area comprising the stepped or relief profile; or the normal duty part could be an extension of the heavy duty part, e.g. separated by a living hinge.

The heavy duty ejector is e.g. activated in case the cards stack has become jammed within the housing such that one is unable to eject the cards by using the normal duty ejector.

The provision of the heavy duty ejector by a projection along the length of the normal duty ejector is an example of providing the normal duty ejector with a first engagement area (e.g. the stepped or relief profile) and longitudinally remote from said area a second engagement area with the to be ejected stack. Typically, in such case the heavy duty ejector will always engage the cards stack first and eject it a slight distance and subsequently, with continued movement of the ejector to its fully extended position, the normal duty ejector will take over the engagement and eject the cards further.

Preferably the heavy duty ejector is designed to eject the cards for at least 10 millimeter and/or the stroke from retracted to extended state is equal for heavy duty and normal duty ejector.

Preferably the ejector arm comprises at least two separate parts (e.g. trigger and barrel), preferably mutually joined by coupling means. Preferably the one part (e.g. called barrel) provides an extension of the other part (e.g. called trigger). This offers the advantage that the parts can be tailored to their function, e.g. shockproof and low friction on the one hand and shockproof and good haptics and appearance on the other hand. Further advantages are mutual disengagement during operation of the arm, e.g. to avoid or overcome jamming; play to allow the free end of the arm to elongate to avoid sticking or wedging of the arm to the cards such that the arm more smoothly returns to its retracted position (tests with the prior art holder revealed that during ejecting the cards, the arm sometimes becomes wedged between two adjacent cards such that the reset means is unable to automatically return the arm to the retracted position since the arm remains "sticked" to the cards that are retained by the retaining means of the holder. Briefly hitting the operating button of the ejector arm releases the arm from the cards, but this generates shocks and noise). Preferably the one part, e.g. barrel, is designed to engage and eject the complete cards stack, e.g. covers the complete thickness of the cards stack, while the other part, e.g. trigger, is designed to engage and eject only a few, not all, cards of the stack, e.g. at least one, two or three cards less from the stack, which is beneficial to overcome jamming of the cards, e.g. covers not more than 80% of the cards stack. Preferably, the trigger is located such that the card closest to each main side will remain disengaged from this part during ejecting the cards, e.g. keeps a gap of at least 0.8 millimeter with both these main sides while moving between the retracted and extended position. In the alternative the trigger keeps a gap of at least 0.8 or 1.2 millimeter with at least one of the main sides while moving between the retracted and extended position.

In an embodiment both parts share a pivot or hinged fixture with the housing, wherein preferably for at least one of the parts, e.g. barrel, the pivot comprises an elongated pivot hole such that this barrel can travel lengthwise.

An alternative embodiment provides that the one part, e.g. barrel, has two pivots, one with the housing, the other with the other part, e.g. trigger.

Preferably the with the cards engaging end of the one part, e.g. barrel, ends further away from the with the housing associated pivot compared to the other part, e.g. trigger, preferably at least 10% or 25% or 50% or 75% further away. By way of example, the barrel is longer, measured from the with the housing associated pivot to the with the card engaging end, preferably at least 10% or 25° or 50% or 75%. The trigger length is preferably between 25% or 40% and 60% or 75%, e.g. approximately 50%, of ejector arm length.

Preferably the parts are mutually joined by a break coupling which uncouples damage free above a load threshold and can be re-coupled such that uncoupling can be repeated many times during the service life of the product. The break coupling is e.g. provided by form fit or tight fit or force fit or friction fit. E.g. a friction coupling or a snap coupling is feasible. Preferably uncoupling requires a higher load compared to re-coupling, e.g. at least 5% or 10% or 15% or 20% higher.

Preferably one or more of the following applies to the break coupling: location between 25% or 35% and 60% 75%, e.g. approximately 50% of the ejector arm length and/or adjacent the longitudinal free end of the trigger; allows a mutual longitudinal movement between barrel and trigger of at least 0.5 millimeter before uncoupling starts; provided by preferably one or both longitudinally extending, mutually longitudinally slidably engaging, edges at barrel and trigger which longitudinally overlap and/or engage for a longitudinal stroke of barrel relative to trigger for at least 0.5 millimeter.

In an embodiment the one part, e.g. trigger, transmits the driving force from the actuator, e.g. operating button, to the other part, e.g. barrel, via the mutual coupling.

An example of the inventive effect to avoid sticking or wedging of the eject arm (barrel) to the cards during eject is as follows: a distal edge (also called slide cam) of the trigger, e.g. at its longitudinal end, bears against a stop edge at the barrel in such manner that if the trigger is pivoted from its retracted position by operating the actuator, the barrel is forced to follow this movement. Due to the resistance of the cards against ejection (e.g. due to the friction means of the holder engaging a main or minor side of the cards), applying a force to the distal end of the barrel opposite the direction of rotating of the trigger and barrel to the extended position, and due to the mutual orientation and/or shape of the slide cam and the associated stop edge, the driving force from the trigger is partly split in longitudinal direction of the barrel, such that the barrel is slightly moved away longitudinally from the trigger (translating movement), as if the barrel longitudinally elongates. Thus, initially when starting from the retracted position of the ejector, the barrel longitudinally translates besides its pivoting or rotation with the trigger. This elongation of the barrel is against the action of a reset means, e.g. spring such that the elongation is limited. As long as the trigger urges the barrel to the extended position and simultaneously the barrel urges the cards to exit the holder, this elongation of the barrel is maintained. However, as soon as the driving force of the trigger is removed, the force component from the trigger acting longitudinally on the barrel disappears, resulting in the reset means withdrawing the barrel longitudinally as if it shrinks longitudinally, which movement demands less effort from the reset means compared to returning to the retracted position of the complete ejector arm (trigger plus barrel) in case the barrel is wedged between cards (in other words "sticks to the cards"), such that the barrel is reliably disengaged from the cards such that even when sticking happens, the complete ejector arm always automatically returns to the retracted position by action of the reset means as soon as the actuator (e.g. operating button) is released.

In an embodiment, the ejector arm is designed to elongate by being provided with telescoping parts, e.g. barrel and trigger. Elongation is preferably at least 0.5 millimeter.

Preferably one or more of the following applies to the reset means, e.g. spring, preferably tension spring and/or coiled spring, of the ejector arm: operates parallel to the extension of the arm or at a sharp angle of 10 or 15 or 20 degrees maximum both in the retracted and extended position and preferably one or more or all positions in between; is joined to the holder at a location between the location of the joint of the reset means to the arm, when the ejector arm is in the completely retracted position, and the pivot of the arm or beyond this pivot as viewed from said joint; is joined to the holder at a location within 5 millimeters from the location where the eject arm is mounted to the holder (e.g. the holder fixed ejector arm pivot). This allows the free end of the arm to elongate to avoid sticking of the arm to the cards such that the arm more smoothly returns to its retracted position.

The prior art reset means, e.g. known from above cited WO2010137975, is joined to the holder at a location beyond the joint of the reset means to the arm, as viewed from the pivot of the arm, thus near the distal end of the eject arm if in its retracted position, and extends parallel to the eject arm only if in its retracted position, while in its extended position the reset means extends almost perpendicular to the eject arm, thus the reset means covers a stroke of approximately 45 degrees while the eject arm moves from the retracted to the extended position.

Thus, according to the invention the reset means is oriented differently compared to the prior art.

The reset means preferably is present aside, preferably straight aside, one or more of the eject arm, trigger and barrel (or at least the stepped part of it), in different words is adjacent a side of the eject arm, trigger or barrel facing in the direction of movement between the extended and retracted position. Prior art applies the spring straight above or below the eject arm. Preferably the reset means extends parallel to such side and/or covers such side at least partly. The reset means preferably is fixed to the barrel means. The trigger means is preferably free from a reset means.

Figure 30:
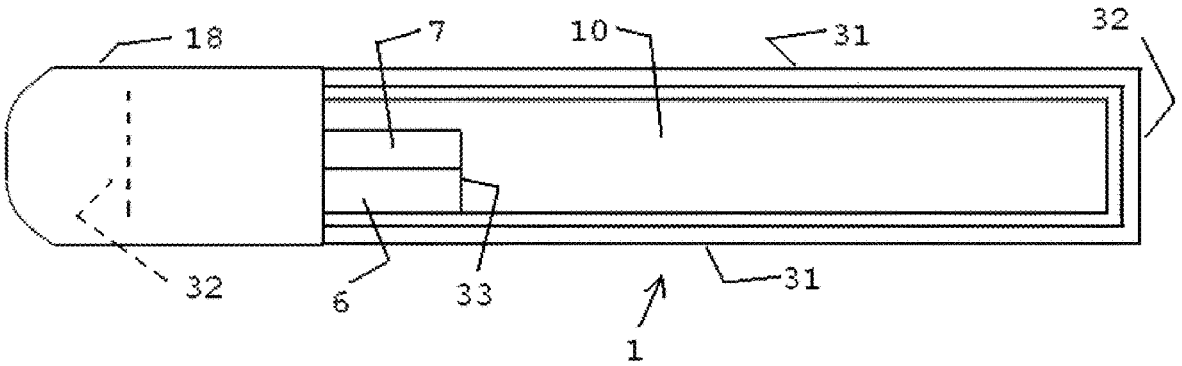

The element closing the holder opposite the cards access opening preferably has a aperture or window through which the barrel and trigger are visible and/or project into (e.g. illustrated in FIG. 30).

The invention also relates to each and any combination and permutation of the above individual inventions.

BRIEF DESCRIPTION OF THE SEVERAL VIEWS OF THE DRAWING(S)

Figure 2:
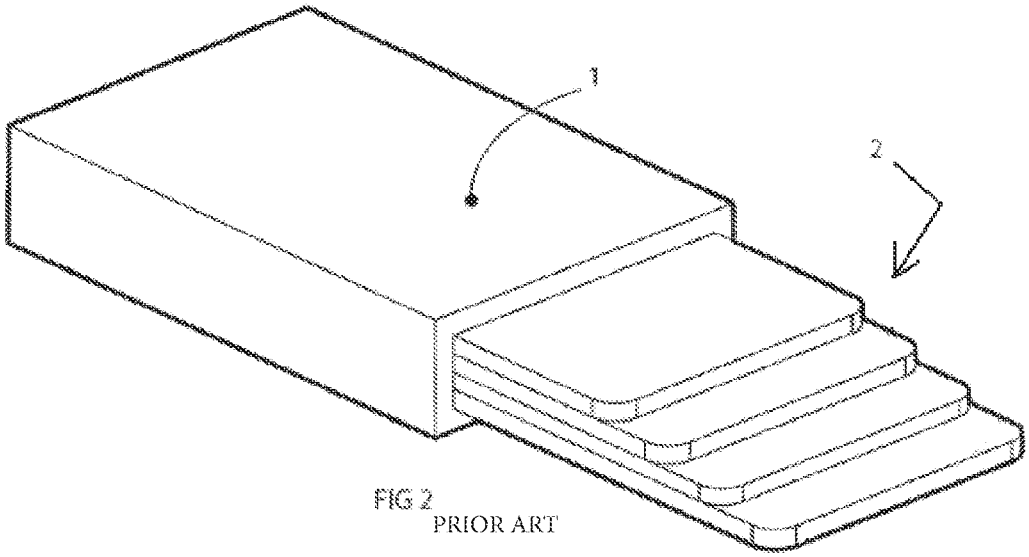
FIG 2 PRIOR ART
Figure 3:
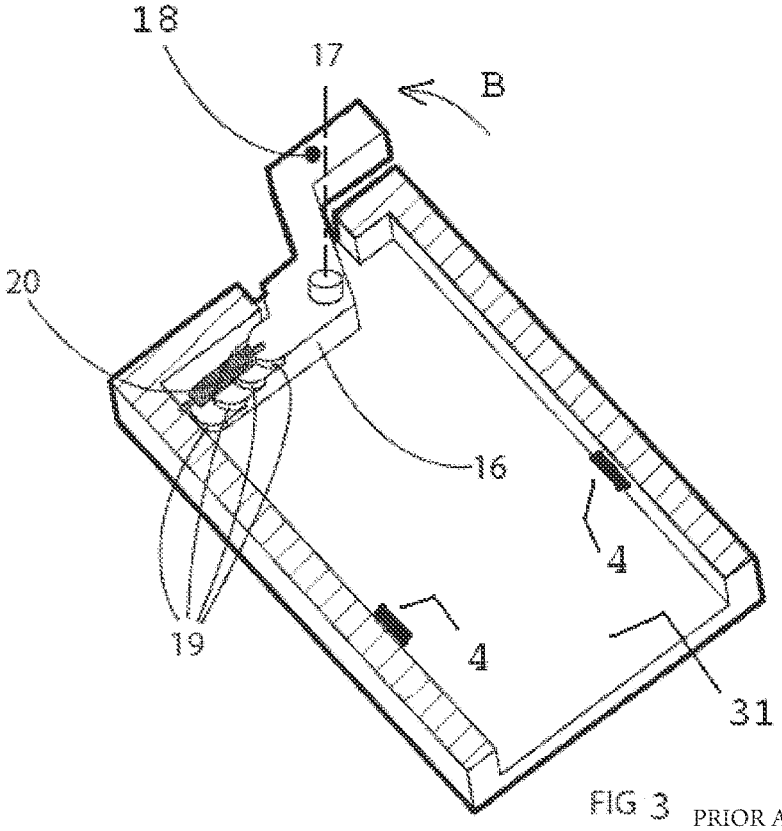
FIG 3 PRIOR ART
Figure 4:
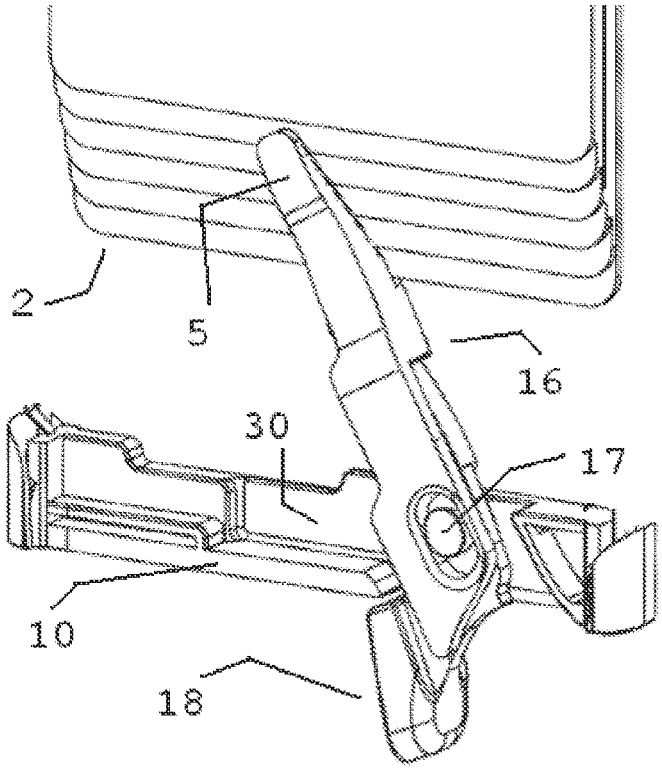
Figure 5:
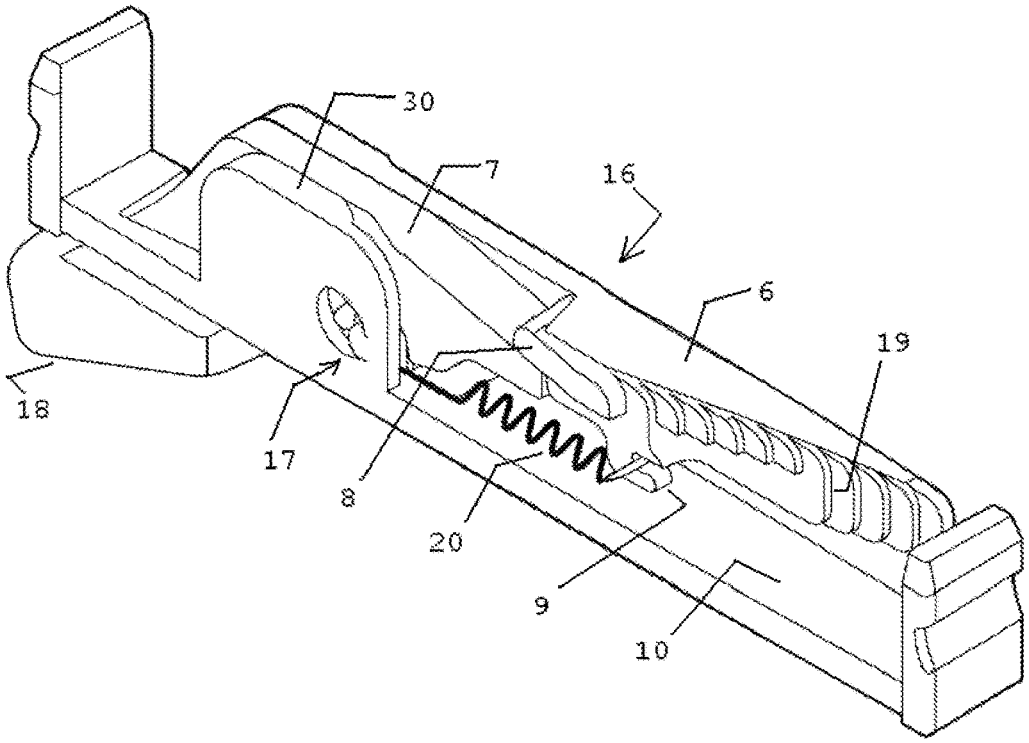
Figure 18:
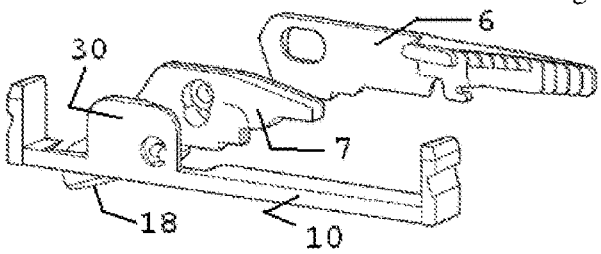
Figure 19:
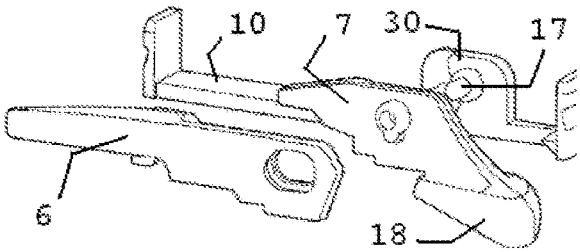
Figure 24A:
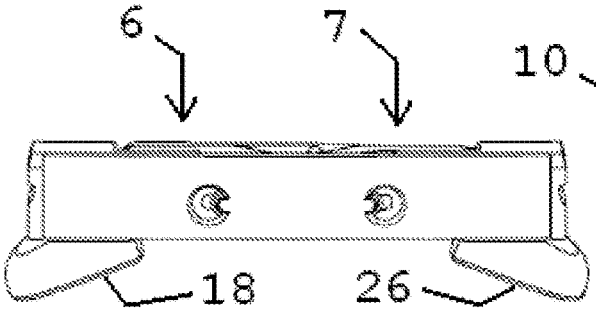
Figure 24B:
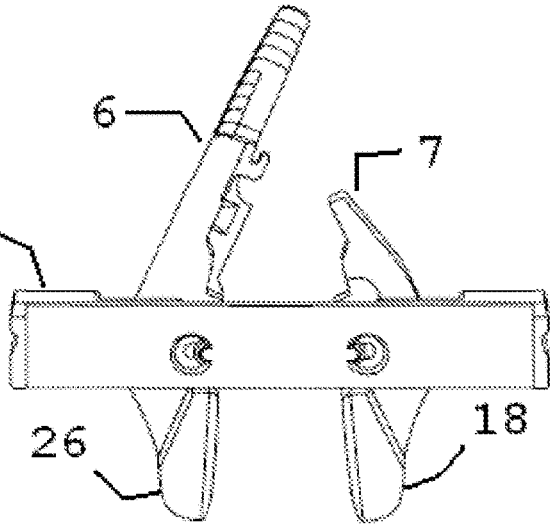
Figure 25:
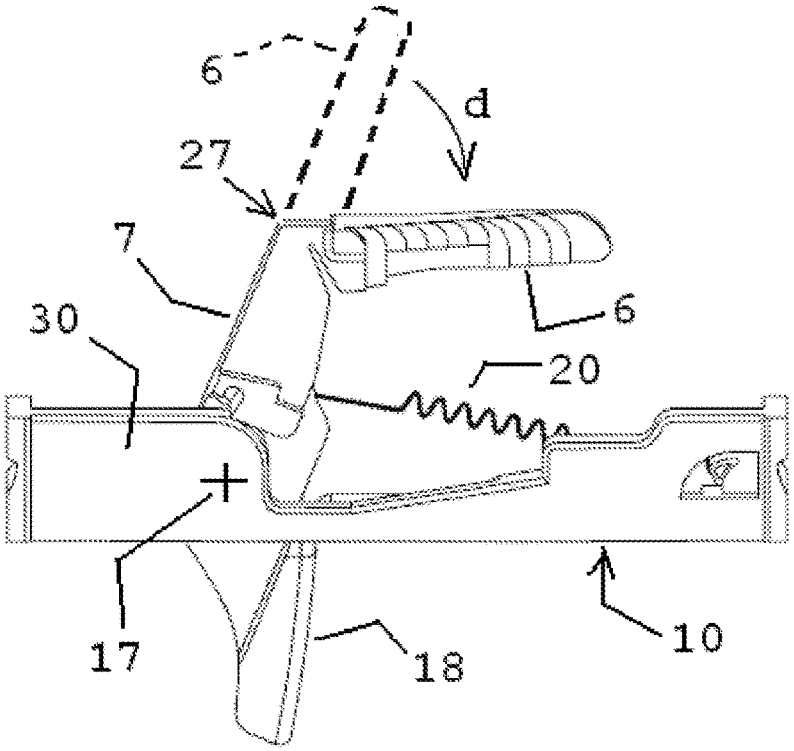
Figure 26A:
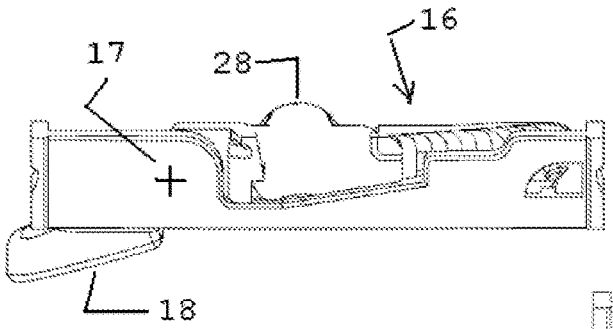
Figure 26B:
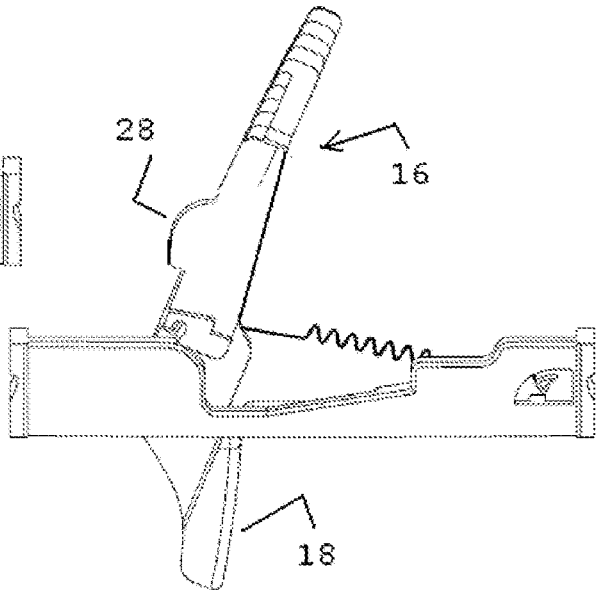
Figure 29:
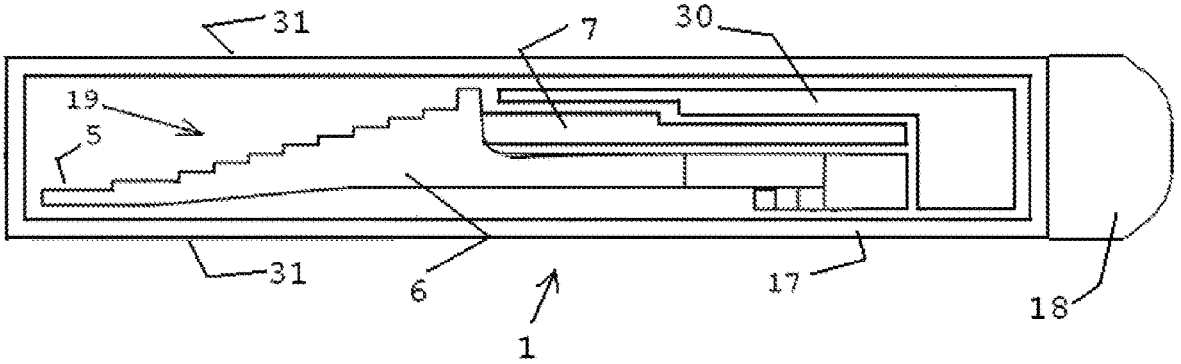

The invention will now be further explained by way of the drawing, showing presently preferred embodiments. The drawing shows in:

FIGS. 1-2 a card holder, in perspective view;

FIG. 3 a cross section of the FIG. 1 card holder;

FIG. 4 in perspective view a pivoted ejector arm engaging a staggered cards stack;

FIGS. 5-12 in perspective view a first embodiment of the invented ejector arm during different stages of its operation;

FIGS. 13-17 in perspective and side view the FIG. 5 ejector arm in different positions;

FIGS. 18 and 19 a perspective exploded view of the FIG. 5 ejector arm from opposite sides;

FIGS. 20-23 perspective views of two alternative embodiments of a double hinged ejector device of the invention in two operating states;

FIG. 24A-B in perspective side view an embodiment of mutually separate and independent normal duty and heavy duty ejector arms;

FIG. 25 in perspective side view an embodiment of normal duty and heavy duty operation provided by a unitary ejector arm;

FIG. 26A-B in perspective side view another embodiment of normal duty and heavy duty operation provided by a unitary ejector arm;

FIG. 27A-E elaborate the operation of the break coupling;

FIG. 28A-F elaborate the operation of another break coupling;

FIG. 29 a top view of the FIG. 5 embodiment; and

FIG. 30 a bottom view of the FIG. 5 embodiment.

DETAILED DESCRIPTION OF THE INVENTION

FIGS. 1-3 show a perspective view of the housing of the card holder which tightly fits around the shown stack of at least three cards (four are shown), wherein one of the two longitudinal ends of the housing is referred to as a card opening because it is opened to receive and remove cards. The tightly fit around the card stack implicates a main shape based on a right angled brick, but it can of course, for reasons of design or ergonomics, differ, e.g. by providing chamfers, roundings, ribs, etc.

FIG. 1 shows the holder 1 and a neat stack 2 of four cards in register, ready to be loaded into the holder through the cards opening 3. If completely located in the holder, the lower side of each card is in register with a relevant engagement face of the ejector arm in its first (retracted) position. Starting from this position of the ejector arm and moving (pivoting) it to its second position, the cards will be forced by the associated engagement face such that the cards stack is partly ejected. Since each engagement face has a different distance to the pivot point of the ejector arm, each card will travel a different distance such that a staggered ejected stack 2 is obtained (shown in FIG. 2 in which the ejector arm (not shown) is in its second position), each card presenting an exposed narrow strip of a main side as shown.

FIG. 3 shows in sectional view a holder (without cards) with a card eject feature (in the first (retracted) position) provided by the stepped element 16 which can pivot around an axis 17 if the user exerts in the pivot direction (according to the arrow B) a force through the actuator 18 outside the housing. The stepped element is made from steps providing card contact faces 19 designed to exert force against the minor side of the cards to be ejected. The card contact faces 19 can be regarded as the thickness of the steps in the stepped shape and the height of these faces is equal to or smaller then the nominal card thickness (approx. 0.8 mm), whereby each step contacts a different card. A reset spring 20 ensures that the stepped element 16 after releasing the button 18 returns immediately and automatically to the initial (first) position shown. Friction elements 4, e.g. pads of rough fibre like material, e.g. felt, are located mutually opposite within the housing at the housing minor sides to engage each individual minor card side to retain the cards against gravity force.

In a possible variant of FIG. 3, the stepped element 16 can translate in the direction in which the cards are slid through the card opening 3 and out the housing and which by means of a reset spring 20 after releasing the operation part 18 returns immediately and automatically to the initial position.

FIG. 3 shows the connection between the button 18 and the ejector arm 16 extending through a passage in the bottom edge, meaning the edge opposite the opening 3. Alternatively such passage could be present in a side edge or even in a main side 31. The button 18 is shown adjacent the bottom edge, however could be located adjacent a side edge or even a main side 31. The bottom edge or side edge is a minor side, bridging the main sides 31. These locations of the passage and button 18 are known from the prior art.

In FIG. 4 the housing is removed such that the elements within the housing are visible. The eject arm 16 is pivoted to its second (extended) position, engaging the staggered cards stack 2 (only partly shown). Arm 16 is, by pivot 17, pivotably mounted to a fixture 10 which is fixedly located in the housing opening opposite the card opening 3, thus providing a closure of the housing.

As is clear from all FIG. 1-4, the thickness of the ejector arm stepwise decreases from the proximal (close to the pivot point 17) to the distal (free or remote) end 5. The maximum ejector arm 16 thickness equals the height of the housing determined by the clearance between the two main sides of the housing which equals the maximum thickness of a cards stack tightly fitting in the housing. The maximum ejector arm 16 thickness could be slightly thinner to allow movement of the arm 16 within the housing without undue friction with the inner faces of the opposite housing main sides along which the top and bottom side, respectively, of the arm 16 slide.

The opposite main side walls 31 have smooth, level and flat inner faces, extending mutually parallel.

Figure 6:
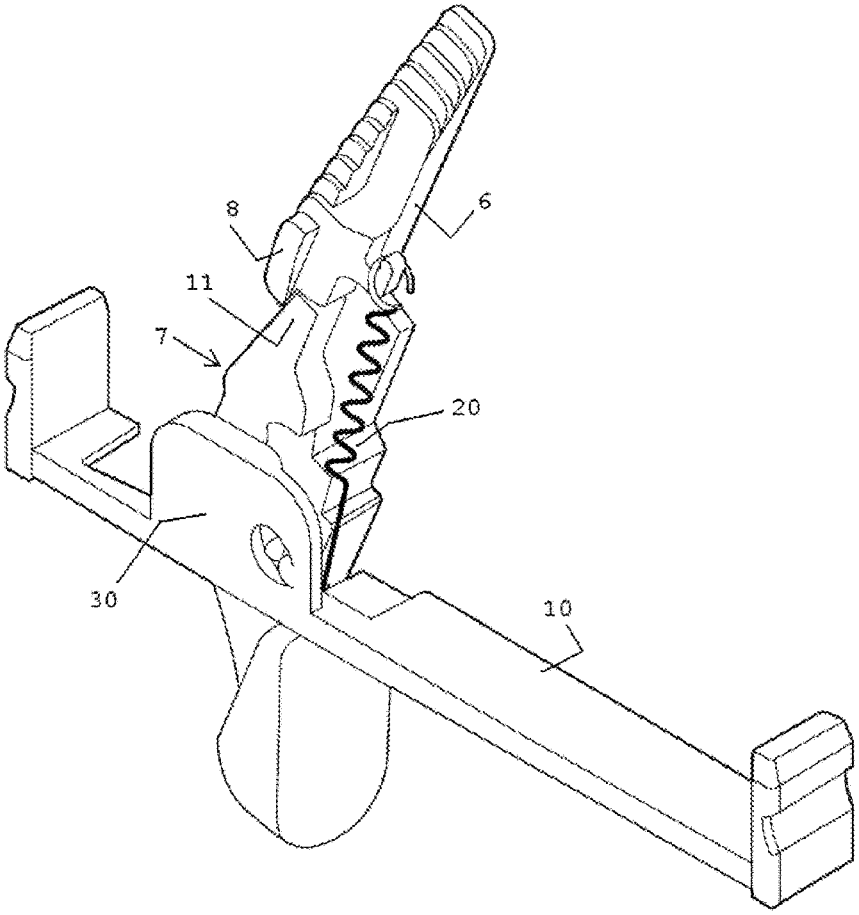

FIGS. 5 and 6 show an embodiment of the invention during normal operation. Also the modified application of the reset spring 20 is illustrated, clearly different from the prior art solution (as shown in FIG. 3). At location 9, spring 20 is mounted to barrel 6. The opposite end (not visible) of spring 20 is mounted to the ejector arm fixture 10 adjacent the pivot 17. In this manner spring 20 remains parallel to arm 16 during pivoting of arm 16.

The arm 16 is assembled from two separate parts: barrel 6 and trigger 7, sharing a common pivot 17 and mutually reversibly coupled by slide cam 8 at barrel 6. Trigger 7 is rigidly coupled with button 18. Barrel 6 is biased towards the retracted position according to FIG. 5 by the spring 20. By operating button 18, trigger 7 is pivoted to the FIG. 6 position, carrying barrel 6 along due to engagement between the distal or free end 11 (also called nose) of the trigger 7 and the slide cam 8.

Figure 7:
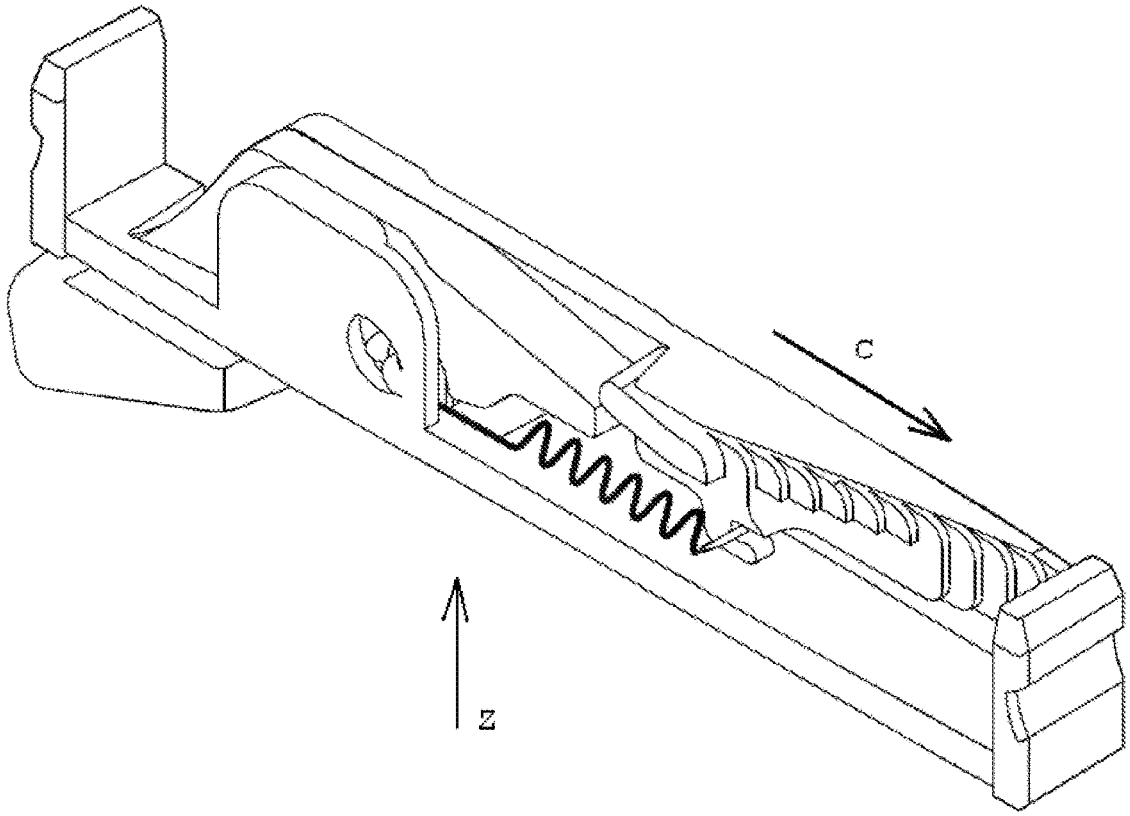
Figure 8:
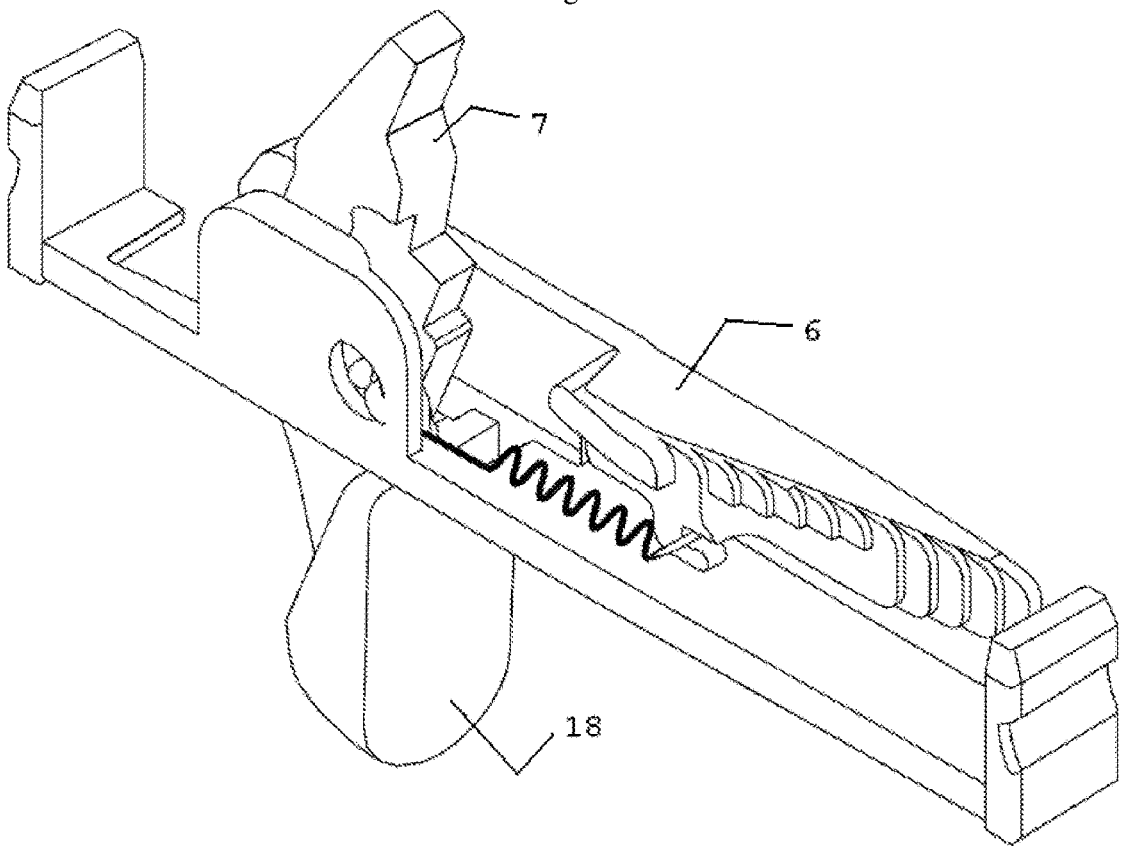

FIGS. 7 and 8 illustrate heavy duty operation. During pivoting of the trigger 7 towards its extended state, when the barrel 6 experiences resistance, e.g. due to jamming of barrel 6 or the cards stack, the nose 11 and the slide cam 8 mutually move, causing the barrel 6 to move longitudinally (see arrow C), opposite to the bias of the spring 20. While nose 11 and slide cam 8 are still engaged, if actuation of button 18 is stopped, spring 20 returns barrel 6 to its original state. If actuation of button 18 is continued with increasing force, nose 11 pushes slide cam 8 and thus barrel 6 forward such that finally nose 11 can pass slide cam 8, at which time the coupling between trigger 7 and barrel 6 breaks reversibly and trigger 7 is free to pivot further towards its extended state (FIG. 8). As soon as barrel 6 is uncoupled from trigger 7, the spring 20 returns barrel 6 to its retracted state as FIG. 8 shows.

From the FIG. 8 position, the trigger 7 is pivoted back to its initial position by operating button 18, during which nose 11 will hit slide cam 8 from above. Application of some additional force to button 18 will cause that nose 11 pushes slide cam 8 and thus barrel 6 forward such that finally nose 11 can pass slide cam 8, after which spring 20 moves barrel 6 back and the engagement between nose 11 and slide cam 8 as shown in FIG. 7 is recovered.

The skilled person is able, without inventive effort, to adapt the shape of the nose 11 and the slide cam 8 to obtain the reversible break coupling between trigger 7 and barrel 6.

Figure 9:
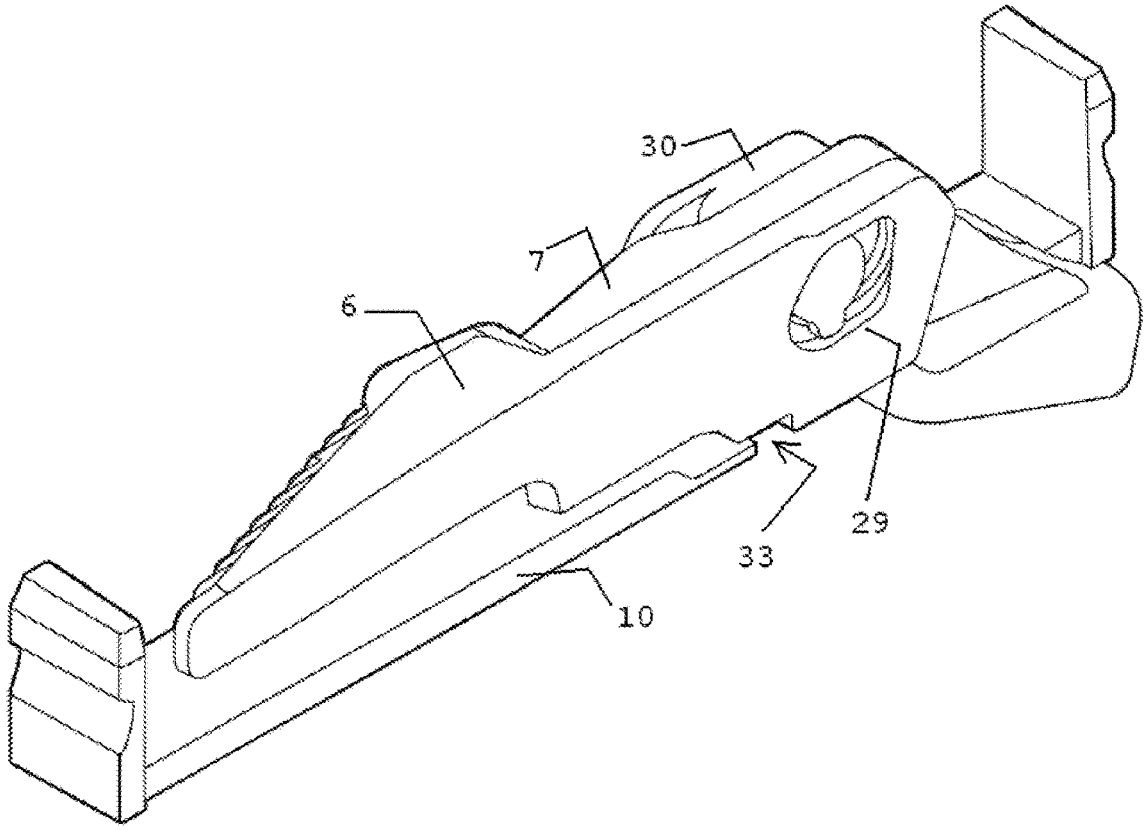
Figure 10:
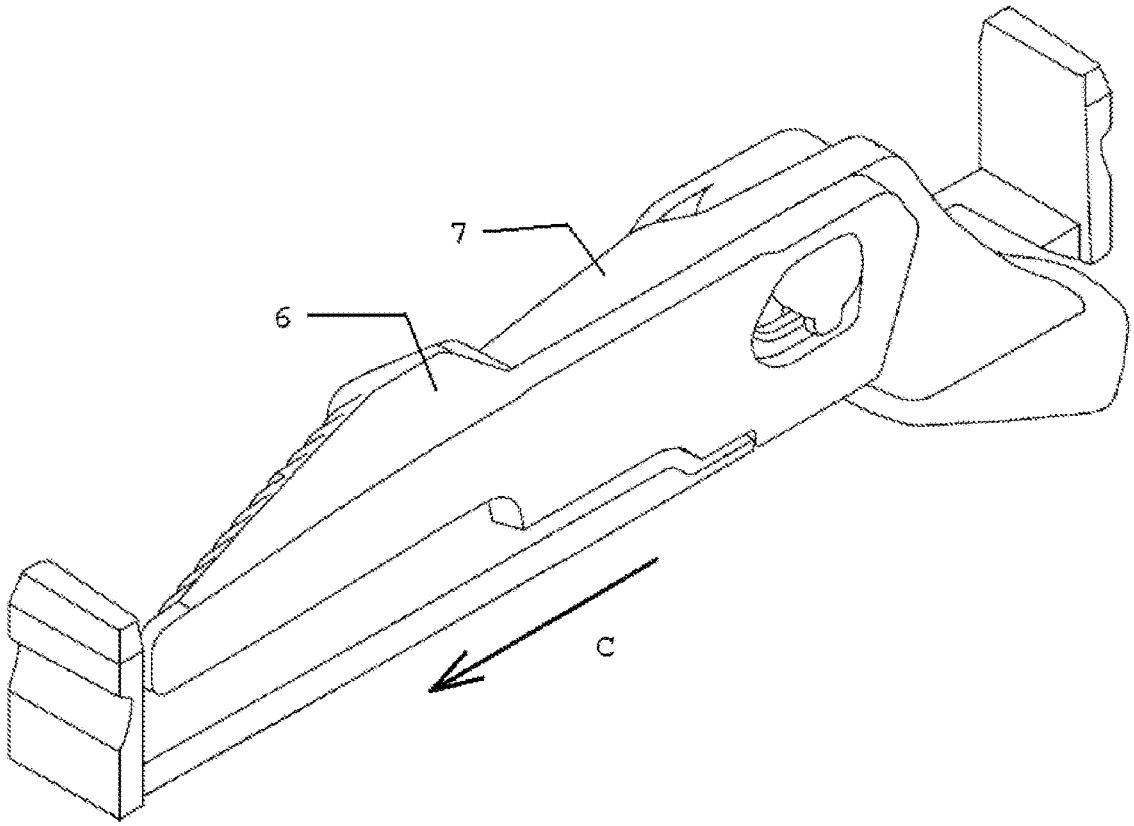

FIGS. 9 and 10 show the arm 16 from the opposite side, illustrating the elongated pivot hole 29 in the barrel 6 to allow barrel 6 to move longitudinally (arrow C) during heavy duty operation. FIG. 9 shows the initial state and FIG. 10 the forward moved barrel 6, caused by engagement of the nose 11 and slide cam 8.

Figure 11:
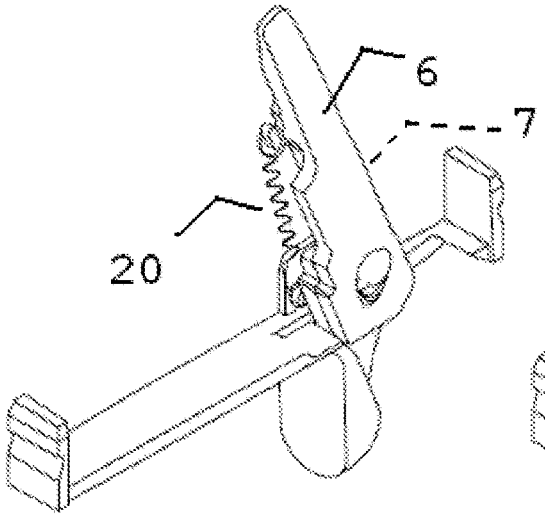
Figure 12:
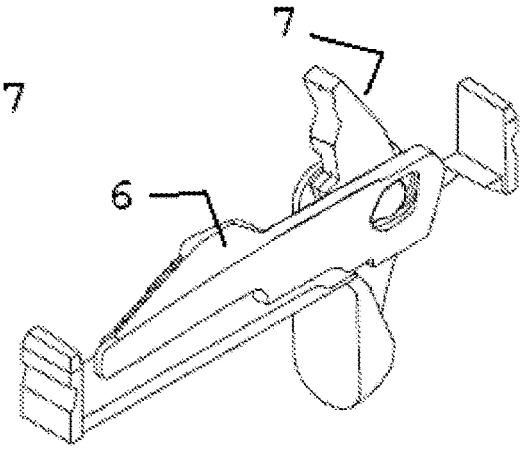

FIGS. 11 and 12 show the arm 16 from the opposite side during normal operation (FIG. 11) and heavy duty operation (FIG. 12), in both states the trigger 7 is pivoted to its second position. In FIG. 11 trigger 7 is pivoted together with barrel 6, such that trigger 7 is hidden behind barrel 6, reason why trigger 7 is referred by a dotted arrow in FIG. 11.

Figure 13:
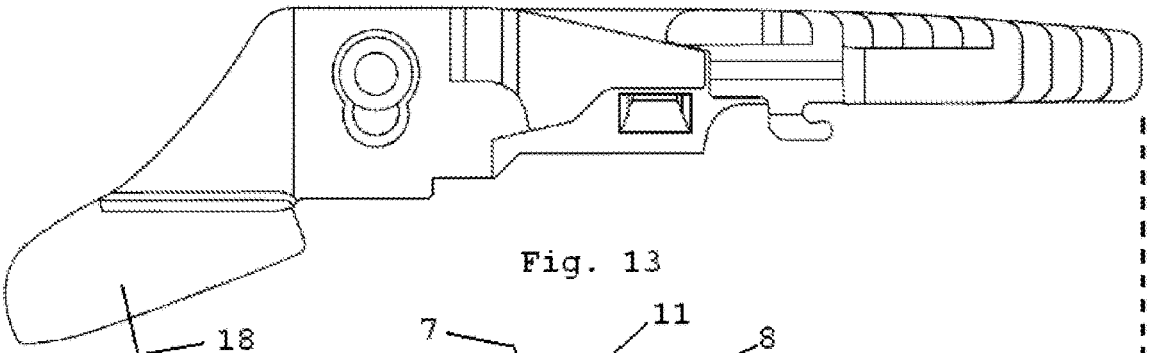
Figure 14:
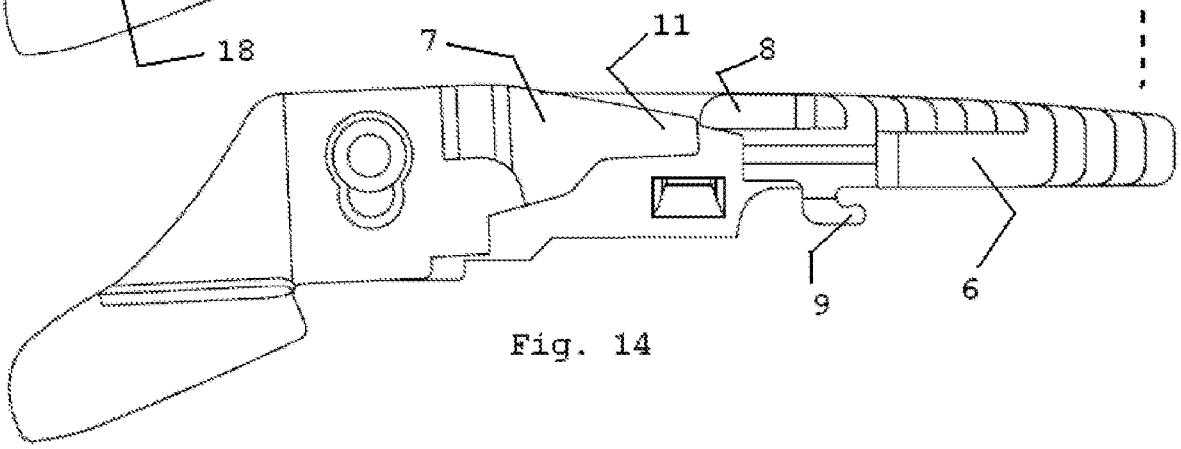

FIGS. 13 and 14 illustrate the forward movement of the barrel 6, against the bias of spring 20. Appreciate that trigger 7 slightly pivots relative to barrel 6 to cause barrel 6 to move forward. The dotted line at the right hand side of the drawing illustrates the rate of forward movement of barrel 6.

Figure 15:
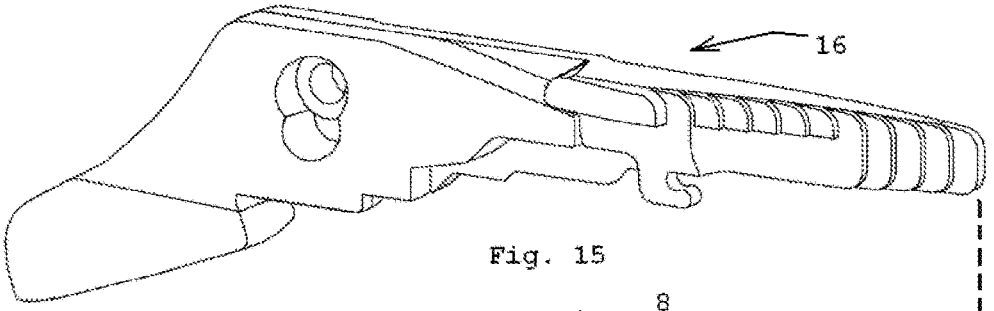
Figure 16:
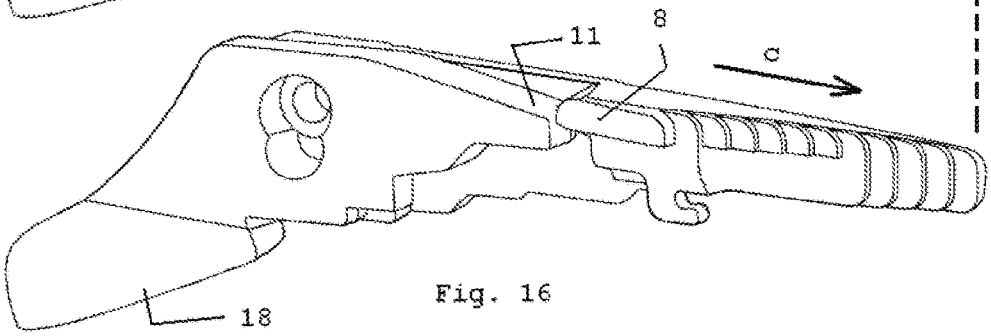

FIGS. 15 and 16 illustrate the same as FIGS. 13 and 14, this time in perspective view.

Figure 17:
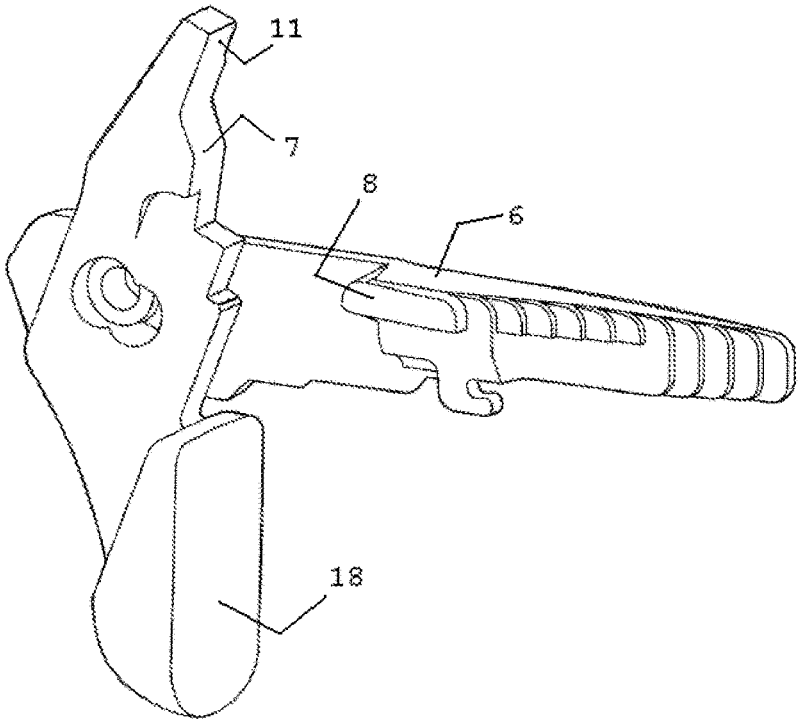

FIG. 17 illustrates the separate arm 16 while trigger 7 uncoupled from barrel 6.

FIGS. 18 and 19 show perspective exploded views from opposite sides of parts 6, 7 of arm 16 and the fixture 10, in FIG. 19 the shaft of pivot 17 is visible.

FIGS. 20-26 show five alternative embodiments of the arm 16 designed for reversibly switching between normal and heavy duty operation.

FIGS. 20-21 and FIGS. 22-23, respectively, show a first and second example in two operating states of a double hinged embodiment, wherein the barrel 6 is hingedly mounted to the distal end of the trigger 7 by a pivot 21 in addition to the pivot 17. Trigger 7 and barrel 6 are mutually separate parts and kept mutually in line by a reversible break coupling.

Figure 20:
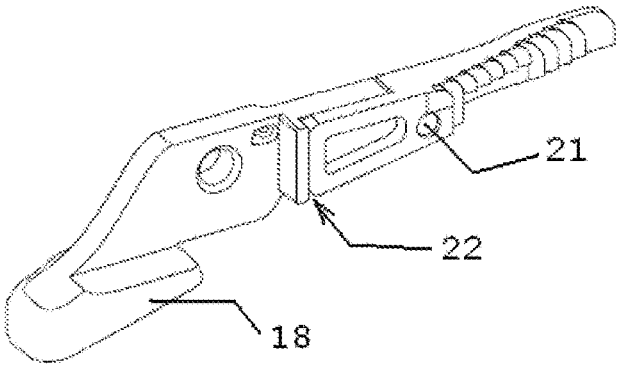
Figure 21:
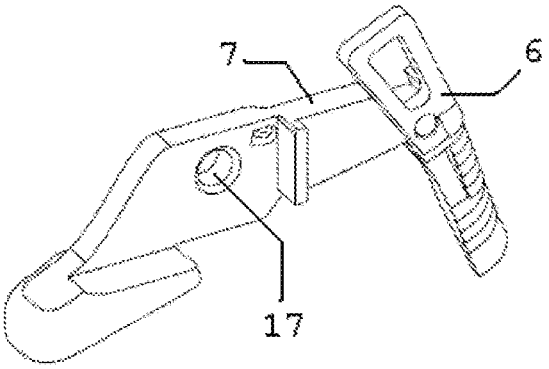

FIG. 20-21 show an at location 22 active friction coupling (viz. FIG. 21) which disengages above a predetermined load acting on the barrel 6 while ejecting the cards, at which time barrel 6 is released for free pivoting around pivot 21 (viz, FIG. 21) such that the distal end of trigger 7 only will urge the cards out of the housing. Operating button 18 opposite the direction of ejecting the cards forces the trigger 7 and barrel 6 mutually in line, recovering the friction coupling acting as reversible break coupling.

Figure 22:
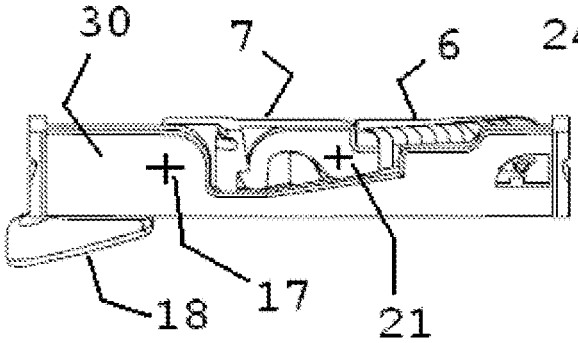
Figure 23:
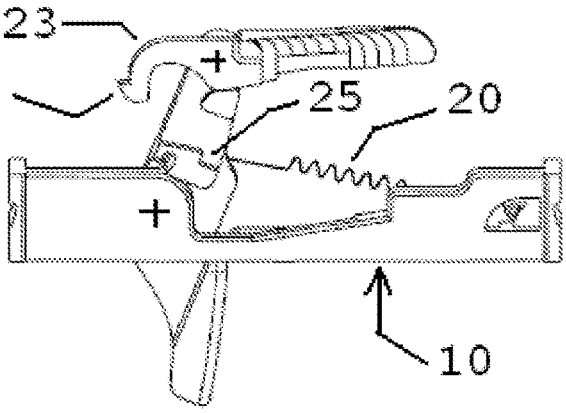

FIG. 22-23 show a different reversible break coupling, provided by form fit, wherein a flexible backward extension 23 of the barrel 6 carries a hooking edge 24 which during normal duty use (not shown) when the trigger 7 and barrel 6 are mutually in line, hooks behind a corresponding hooking edge 25 at barrel 6. Above a predetermined load carried by the barrel 6 during ejecting the cards, extension 23 yields such that hooking edge 24 moves free from hooking edge 25, causing the break coupling to disengage. By operating button 18 opposite the direction of ejecting the cards recovers the break coupling.

FIGS. 22 and 23 also show the application of the reset spring 20 corresponding to the prior art, thus similar to FIG. 3 and clearly different from FIG. 5 which shows an inventive example.

FIG. 24A-B show a normal duty ejector arm 6 operated by button 18 and a heavy duty ejector arm 7 operated by button 26, such that operation of these arms 6, 7 is mutually independent. FIG. 24A shows the retracted and FIG. 24B the extended position of both arms 6, 7. In stead of mutually opposite as shown, in an alternative the arms 6, 7 and/or buttons 18, 26 could be located differently, e.g. side by side.

FIG. 25 shows the trigger 7 and barrel 6 as a single part wherein barrel 6 can pivot relative to trigger 7 by application of a living hinge 27 at the area where barrel 6 and trigger 7 merge. This living hinge provides a virtual hinge, thus a physical pivot axis 21 is absent. The fully extended position of the eject arm during heavy duty operation is shown. The dashed lines show the barrel 6 position during normal duty operation. Arrow d indicates the direction of pivoting of barrel 6 when switching from normal to heavy duty operation.

FIG. 26A-B show an ejector arm 16 as a unitary item, similar to FIG. 3, carrying a fixed projection 28 at the side facing the cards within the house. When pivoting from the retracted state of FIG. 26A to the extended state of FIG. 26B, the projection 28 first engages the facing edge of the cards urging them outwards, subsequently the distal end of arm 16, carrying the stepped profile, takes over the engagement with the facing cards edge to further urge them outwards. In this manner, projection 28 operates similar to the trigger 7 during heavy duty operation, and the distal end of arm 16 operates similar to the barrel 6. In this example, however, projection 28 always engages the cards during the initial phase of pushing the cards outward, while the distal end of arm 16 only engages the cards after the initial phase is completed. Thus, with this example, the initial phase is always as if heavy duty operation is required.

Figures 27A, 27B, 27C, 27D, 27E:
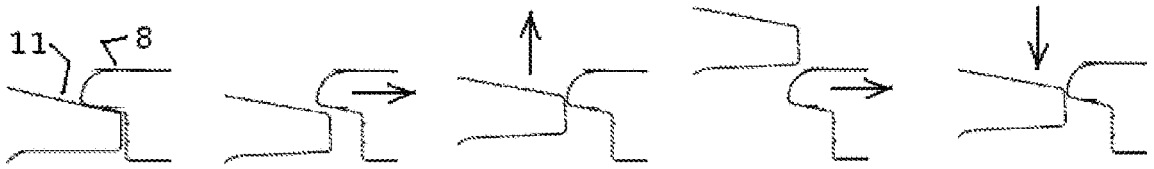

FIG. 27A-E illustrate operation of the break coupling applied in the embodiment shown in e.g. FIG. 13. Starting from FIG. 27A showing the engaged coupling, the one inclined stop face and the contact edge of the two coupling parts start mutually bearing and sliding (FIG. 27B) when operating the button 18 (viz. FIG. 13) to eject the cards, opposite the bias of spring 20. At arrival of the threshold load the coupling becomes disengaged since the coupling parts no longer provide a mutual barrier for the load from the trigger 7 to pivot the barrel 6 (FIG. 27C). To re engage the coupling parts the button 18 is operated oppositely and the other inclined stop face and the contact edge start mutually bearing and sliding (FIG. 27D) until they can mutually pass (FIG. 27E), after which the reset spring 20 moves the parts to the initial stage (FIG. 27A) completing re engagement.

Figures 28A, 28B, 28C, 28D, 28E, 28F:
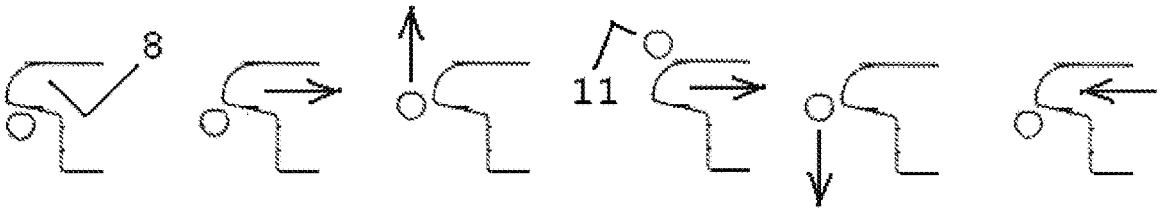

FIG. 28A-E illustrates the same stages as FIG. 27A-E for a different shape of the contact face. FIG. 28F shows additionally an intermediate stage between FIG. 28E and FIG. 28A, illustrating the movement caused by the reset spring 20.

FIG. 29 the view when looking into the holder 1 from the entrance 3 and illustrates the small thickness of the trigger 7 compared to the barrel 6 in the area provided with the faces 19 (here barrel 6 fits tightly between the main sides 31). The trigger 7 is sandwiched between the thin part of barrel 6 adjacent pivot 17 and a spacer 30 (also illustrated in, e.g., FIGS. 4 and 6) to locate the trigger 7 stably between the opposite main sides 31 of the housing 1. Thus, the trigger 7 is kept spaced from both main sides 31.

FIG. 30 the view according to arrow Z in FIG. 7 (the view opposite FIG. 29). The one minor side 32 is shown by a dashed line since covered by button 18. The fixture 10 contains a window 33 (also referred to in FIG. 9) through which the barrel 6 and trigger 7 are visible. The barrel 6 and the trigger 7 project into this window 33.

The mutual spacing of the components shown in FIGS. 29 and 30 is exaggerated for clarity.

FIGS. 5-8 and 11 show the reset spring 20 is present straight aside the trigger 7 and barrel 6 and extends parallel to these parts 6, 7 and covers these parts 6, 7 partly. This is different from FIG. 3 in which the spring 20 is present straight above the eject arm and also the steps 19. The spring 20 is merely fixed to the barrel 6. The drawing, the specification and claims contain many features in combination. The skilled person will consider these also individually and combine them to further embodiments. Also different embodiments belong to the invention. Features of different in here disclosed embodiments can in different manners be combined and different aspects of some features are regarded mutually exchangeable. All described or in the drawing disclosed features provide as such or in arbitrary combination the subject matter of the invention, also independent from their arrangement in the claims or their referral.

The invention claimed is:

1. A holder for cards comprising:

a housing which tightly fits around a stack of at least three cards and has at least one card opening for locating and removing cards, wherein within the housing, opposite the card opening, a card eject feature is provided such that the cards through the card opening can be partly slid from the housing, wherein the card eject feature comprises an eject arm mounted to the housing by a pivot feature, wherein the housing has two opposite main sides providing a mutual spacing defining the thickness direction of the stack of at least three cards and of the eject arm, wherein the eject arm is designed to pivot within the housing between and parallel to the main sides from a first, retracted position to a second, extended position and during said movement ejects the cards by engaging and forcing the cards simultaneously to partly exit the housing, wherein the eject arm has a free longitudinal end and the holder comprises an external actuating feature, to provide force to eject the cards by the eject arm and to drive the eject arm from the first to the second position, wherein the eject arm comprises a part for normal duty operation and a part for heavy duty operation, and both parts are designed to engage and force cards to partly exit the housing, wherein the part for heavy duty operation is designed to provide an at least 10% bigger force to the to be ejected cards for the same force applied to the external actuating feature, in that the part for heavy duty operation provides a short lever arm engaging the cards with a distal end region and the part for normal duty operation provides a long lever arm engaging the cards with a distal end region, wherein the long lever arm is longer compared to the short lever arm, wherein the part for normal duty operation has a stepwise increase of thickness longitudinally from the free longitudinal end of the eject arm that provides step shaped contact faces for ejecting the stack of at least three cards in a staggered fashion wherein the thickness of the part for normal duty operation covers the complete thickness of the stack of at least three cards such that said part is designed to simultaneously engage and eject the complete stack of at least three cards, wherein the part for normal duty operation and the part for heavy duty operation of the eject arm are two separate parts, each designed to engage and force the cards to partly exit the housing, wherein the two separate parts are mutually coupled by a break coupling of reversible type, said break coupling comprising a first coupling part at the part for normal duty operation and a second coupling part at the part for heavy duty operation, wherein the first and second coupling parts are designed to mutually couple the part for normal duty operation and the part for heavy duty operation, wherein said break coupling is designed to disconnect the coupling between the first and second coupling part above a threshold load applied to the external actuating feature to eject the cards, wherein the break coupling is of reversible type since it disconnects the coupling damage free above the threshold load and can be re-coupled such that disconnecting a re-coupling the break coupling can be repeated many times during the service life of the product, and wherein the driving force from the external actuating feature is transmitted from the part for heavy duty operation via the break coupling to the part for normal duty operation.

2. The holder according to claim 1 wherein the part for heavy duty operation has a cards engagement face smaller in width to simultaneously engage not all cards of the stack during ejection and the thickness of the part for heavy duty operation covers not more than 80% of the thickness of the cards stack such that said part is designed to simultaneously engage and eject only part of the cards stack, and wherein the part of the cards stack has at least one card less compared to the complete cards stack.

3. The holder according to claim 1 wherein the eject arm extends from the pivot feature to the free longitudinal end, and wherein the break coupling is located between the pivot feature and the free longitudinal end of the eject arm.

4. The holder according to claim 1 wherein the break coupling comprises:

a biasing reset means;

an assembly of two oppositely sloping stop faces at one of the first and second coupling parts; and a contact edge at the other of the first and second coupling parts in sliding engagement with alternatingly one of said two stop faces, wherein the biasing reset means keeps the first and second coupling parts biased in coupling engagement, and wherein the design is such that the load acting on the coupling to mutually engage or disengage the coupling parts causes the contact edge and the relevant stop face to mutually slide opposite the bias of the biasing reset means.

5. The holder according to claim 4 wherein the biasing reset means is a spring.

6. The holder according to claim 1 wherein the part for heavy duty operation and the part for normal duty operation are commonly mounted to the housing by said pivot feature, the pivot feature comprises an elongated pivot hole allowing the free longitudinal end of the part for normal duty operation to move away from said pivot feature at least 0.5 millimeter.

7. The holder according to claim 1 wherein a reset means is fixed on the one hand to the eject arm at a location and is fixed on the other hand to the housing at a location such that, when the eject arm is in the first position, i.e. the retracted position, a straight line connecting both said locations extends from the location at the eject arm towards the pivot feature where the eject arm is mounted to the housing.

8. The holder according to claim 1 wherein the part for heavy duty operation and the part for normal duty operation have said pivot feature in common.

9. The holder according to claim 1 wherein the break coupling is provided by form fit of parts and a biasing reset means biases the first coupling part and the second coupling part in mutual coupling engagement to provide the form fit of the break coupling.

10. The holder according to claim 1 wherein the external actuating feature is provided by a finger operated button and the part for heavy duty operation and the part for normal duty operation have this finger operated button in common.

11. The holder according to claim 1 wherein the part for heavy duty operation has two pivot features.

12. The holder according to claim 1 wherein the part for heavy duty operation is provided by a projection along the length of the part for normal duty operation in such a manner that there are provided at the eject arm a first engagement area, providing the part for normal duty operation, and longitudinally remote from said first engagement area a second engagement area, providing the part for heavy duty operation, both designed for engagement with the to be ejected cards stack within the housing wherein, starting from the first position of the eject arm and moving to the second position, the second engagement area will always engage the cards stack first and eject it a slight distance and subsequently, with continued movement of the eject arm to its second position, the first engagement area will take over the engagement and eject the cards further, wherein the second engagement part is designed to eject the cards for at least 10 millimeter.

13. The holder according to claim 12 wherein the eject arm has a side facing towards the cards stack and wherein the projection providing the part for heavy duty operation is located between the pivot feature mounting the eject arm to the housing and the first engagement area, and the projection is located at the side of the eject arm facing towards the card stack.

14. The holder according to claim 1 wherein a reset means, is fixed to the part for normal duty operation and is not fixed to the part for heavy duty operation and the reset means biases the eject arm towards the first position.

15. The holder according to claim 1 wherein the actuating feature projects outside the housing and wherein the part for heavy duty operation of the eject arm and the actuating feature are connected in a rigid manner such that the movement of the actuating feature is directly transferred to the part for heavy duty operation of the eject arm and both these members move as one since both these members are integrated in a single, rigid piece.

16. The holder according to claim 1 wherein the external actuating feature is a finger operated button.

17. A holder for cards comprising:

a housing that tightly fits around a stack of at least three cards and has at least one card opening for locating and removing cards, while within the housing, opposite the card opening, a card eject feature within the housing and opposite the card opining, configured such that the cards can be partly slid through the opening, wherein the card eject feature comprises:

an eject arm mounted to the housing by a pivot feature, wherein the housing has two opposite main sides providing a mutual spacing defining the thickness direction of the cards stack and of the eject arm, and wherein the eject arm is designed to pivot within the housing between and parallel to the main sides from a first, retracted position to a second, extended position and during said movement ejects the cards by engaging and forcing the cards simultaneously to partly exit the housing, wherein the eject arm has a free longitudinal end and the holder comprises an external actuating feature to provide the force to eject the cards by the eject arm and to drive the eject arm from the first to the second position, wherein the eject arm comprises a part for normal duty operation and a part for heavy duty operation, wherein both parts are designed to engage and force cards to partly exit the housing, wherein the part for heavy duty operation is designed to provide an at least 10% bigger force to the to be ejected cards for the same force applied to the external actuating feature in that the part for heavy duty operation provides a short lever arm engaging the cards with a distal end region and the part for normal duty operation provides a long lever arm engaging the cards with a distal end region, wherein the long lever arm is longer compared to the short lever arm and the part for normal duty operation has a stepwise increase of thickness longitudinally from the free longitudinal end of the eject arm that provides step shaped contact faces for ejecting the cards stack in a staggered fashion wherein the thickness of the part for normal duty operation covers the complete thickness of the cards stack such that said part is designed to simultaneously engage and eject the complete cards stack, wherein at the inner side of the housing a friction element is located which exerts a friction force to the side edge of each individual card within the housing to retain the cards against gravity force, which friction element is of sufficient dimension to simultaneously engage all cards in the stack and is not rigid;

the cards receiving space is sleeve or shaft like;

the receiving space is designed such that the cards through the card opening parallel to their top face must be slid from this space;

wherein there are provided at the eject arm a first engagement area, providing the part for normal duty operation, and longitudinally remote from said first engagement area and present between said pivot feature and said first engagement area, a second engagement area, providing the part for heavy duty operation, both designed for engagement with the to be ejected cards stack within the housing wherein, starting from the first position of the eject arm and moving to the second position, the second engagement area, providing the part for heavy duty operation, will always engage the cards stack first and eject it a slight distance and subsequently, with continued movement of the eject arm to its second position, the first engagement area will take over the engagement from the second engagement area and eject the cards further wherein the actuating feature projects outside the housing and wherein the eject arm and the actuating feature are connected in a rigid manner such that the movement of the actuating feature is directly transferred to the eject arm and both these members move as one since both these members are integrated in a single, rigid piece;

wherein the second engagement area is designed to eject the cards at least 10 millimeters.

* * * * *